US006050863A

United States Patent [19]

Noda

[11] Patent Number: 6,050,863

[45] Date of Patent: Apr. 18, 2000

[54] STAMPED AND FORMED CONNECTOR CONTACTS

[75] Inventor: Atsuhito Noda, Hachiohji, Japan

[73] Assignee: Molex Incorporated, Lisle, Ill.

[21] Appl. No.: 08/861,881

[22] Filed: May 22, 1997

[30] Foreign Application Priority Data

May 31, 1996 [JP] Japan ..... 8-160824

[51] Int. Cl.[7] ..... H01R 11/22

[52] U.S. Cl. ..... 439/856

[58] Field of Search ..... 439/856, 885

[56] References Cited

U.S. PATENT DOCUMENTS 5,060,372 10/1991 Capp ..... 439/885

5,252,097 10/1993 Lindeberg ..... 439/856

*Primary Examiner*—Renee S. Luebke
*Assistant Examiner*—Javaid Nasri
*Attorney, Agent, or Firm*—A. A. Tirva

[57] ABSTRACT

Disclosed is an improved receptacle contact 1 having first and second contact springs 2 and 3 defining a plug-insertion space 4 therebetween. In the stamped blank the first contact spring 2 includes a straight piece integrally connected to an elongated stem piece 8 and the second contact spring 3 is the handle portion of a crank-like piece 5 whose rod-like piece 10 is integrally connected to the elongated stem piece 8 extending parallel to the first contact spring 2.

The arrangement permits a significant reduction of contact-to-contact intervals and results in reduction of punching and assembling operations.

4 Claims, 8 Drawing Sheets

STAMPED AND FORMED CONNECTOR CONTACTS

FIELD OF THE INVENTION

The present invention relates to receptacle contacts for electric connectors, particularly receptacle contacts whose blanked profiles engages individual receptacle contacts to the arranged in a row at reduced intervals, and the method of manufacturing such receptacle contacts.

DESCRIPTION OF THE PRIOR ART

When an electric connector is made-up by press-fitting a plurality of receptacle contacts in an insulating housing in one or more rows, the receptacle contacts are handled without removing them from their carrier strip thereby permitting simultaneous insertion of the receptacle contacts into the insulating housing. As seen from FIGS. 10 and 11, one of such receptacle contacts 50 has two contact springs 51*a* and 51*b* to define a plug-insertion space 52 therebetween. As seen from these drawings, the receptacle contact 50 is integrally connected to its carrier strip 53 via an associated support piece 54. A sheet of metal is stamped out to provide a parallel-arrangement of receptacle contact blanks integrally connected to the carrier strip 53, each contact blank having two parallel contact springs 51*a* and 51*b* connected by a lateral joint 56, as shown in FIG. 12. The parallel contact springs 51*a* and 51*b* are bent perpendicular to the lateral joint 56 to face each other, as seen from FIGS. 10 and 11. The receptacle contact 50 is the result.

Receptacle contacts are arranged at regular intervals, each being equal to the contact-to-contact distance W, as seen in FIG. 12. This adjacent arrangement of contact blanks, however, makes it difficult to reduce the contact-to-contact distance or interval W. Assuming that receptacle contacts are arranged at reduced intervals (for instance, 2 millimeters) in an electric connector, two sets of receptacle contacts which are arranged parallel at intervals twice as long (for instance, 4 millimeters) are stamped out of a sheet of metal, and after each receptacle blank is bent to a three-dimensional shape 55 as shown in FIGS. 10 and 11, the receptacle contacts are fitted into the insulating housing with their receptacle contacts alternately arranged at a same level. Accordingly the stamping, forming, and assembling steps increase, and accordingly the cost involved for manufacturing such connectors increases.

SUMMARY OF THE INVENTION

One object of the present invention is to provide a blanked profile of a receptacle contact which profile enables receptacle contacts to be arranged at reduced intervals.

To attain this object, a receptacle contact having first and second contact springs defining a plug-insertion space therebetween is improved according to the present invention in that in the blanked profile of the receptacle contact of the first contact spring includes a straight piece integrally connected to an elongated stem piece, and that the blanked profile of the second spring includes a straight portion which is connected via a lateral portion connected to the elongated stem piece by a rod shaped piece extending parallel to the first contact spring.

A plurality of blanked receptacle contacts may be arranged at regular intervals and may be integrally connected to a lateral carrier strip via associated support pieces which are integrally connected to the elongated stem pieces of the receptacle contacts.

Another object of the present invention is to provide a method of making receptacle contacts which can be arranged at reduced intervals.

To attain this object a method of making receptacle contacts each having first and second contact springs, defining a plug-insertion space therebetween, is improved according to the present invention by: preparing a blanked profile of receptacle contacts, a first contact spring of each receptacle contact shape includes a straight piece integrally connected to an elongated stem piece, and the second spring includes a straight portion which is connected via a lateral portion to the elongated stem piece by a rod shaped piece extending parallel to said first contact spring; and forming each receptacle contact by: bending the second contact spring backward; bending the lateral portion perpendicular to the rod-like piece; and finally bending the lateral joint so as to place the rod-like piece perpendicular to the first contact spring thereby locating the first and second contact springs in opposing face-to-face relationship.

Other objects and advantages of the present invention will be understood from the following description of receptacle contacts according to preferred embodiments of the present invention, which embodiments are shown in accompanying drawings.

DESCRIPTION OF PREFERRED EMBODIMENTS

Figure 1:
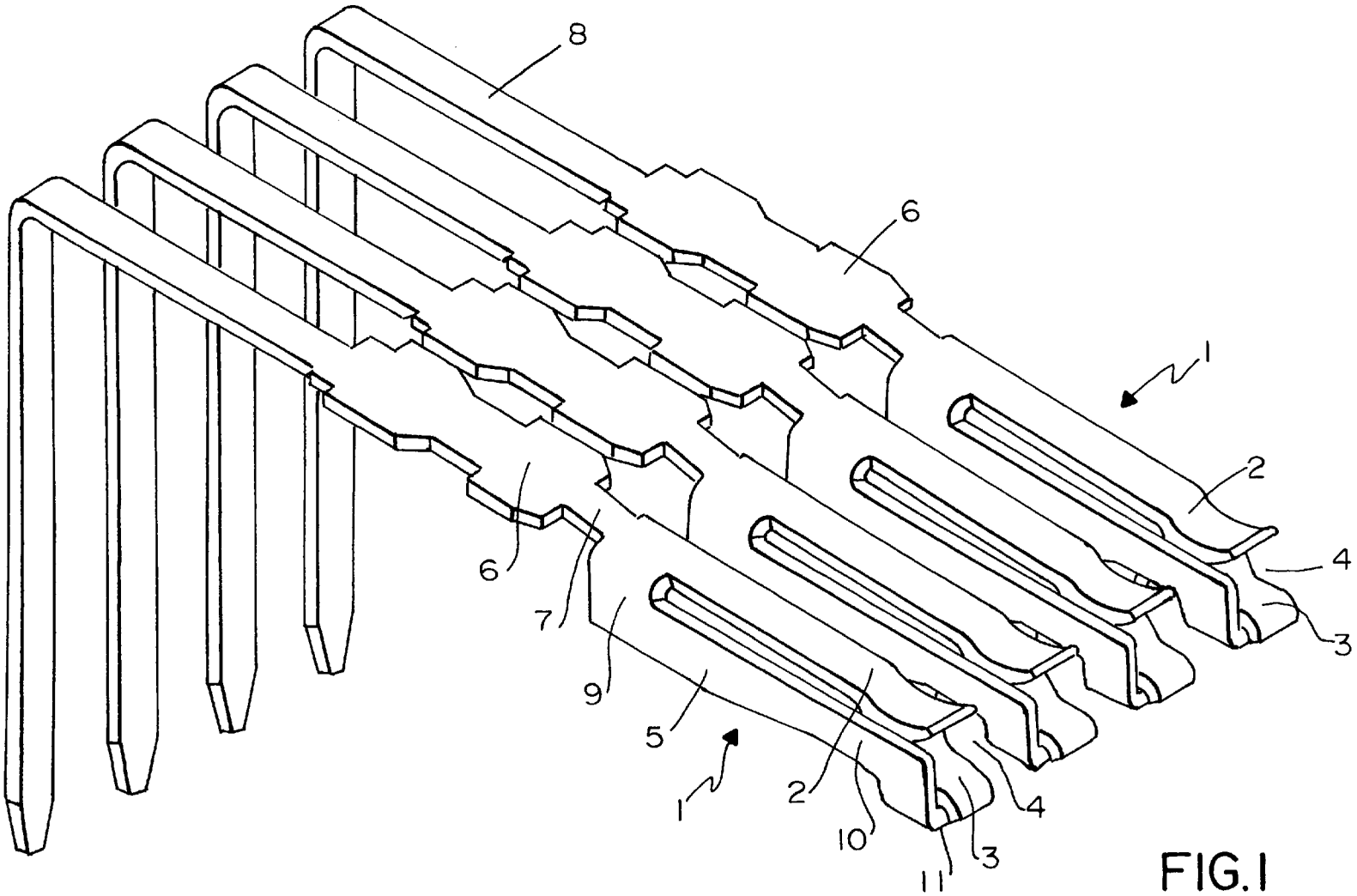
FIG. 1 is a perspective view of the receptacle contacts according to a first embodiment of the present invention.
Figure 2:
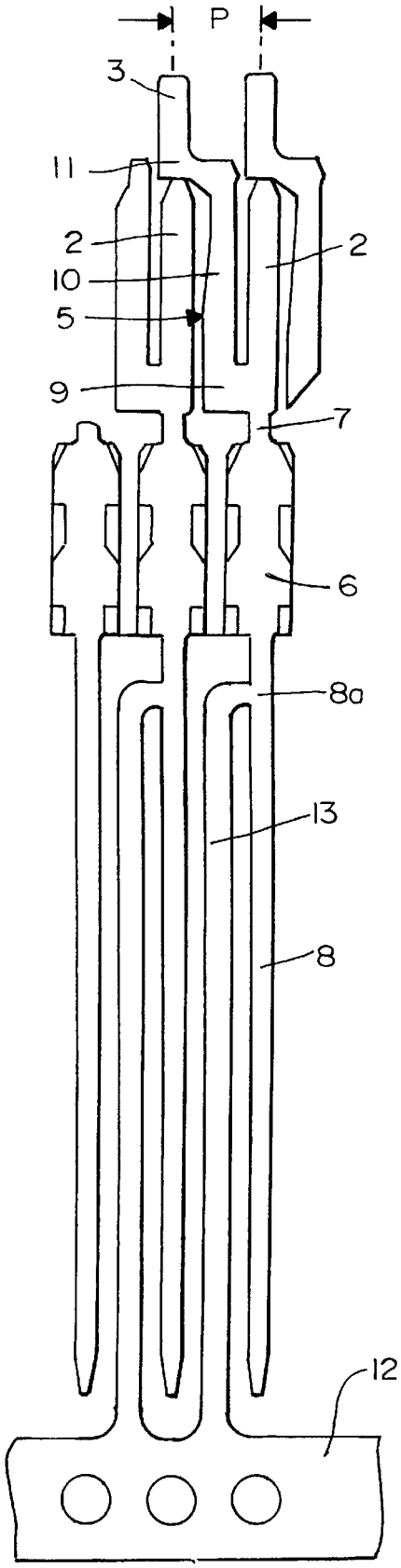
FIG. 2 is a fragmented plan view of a stamped blank of receptacle contacts according to the first embodiment.
Figure 3:
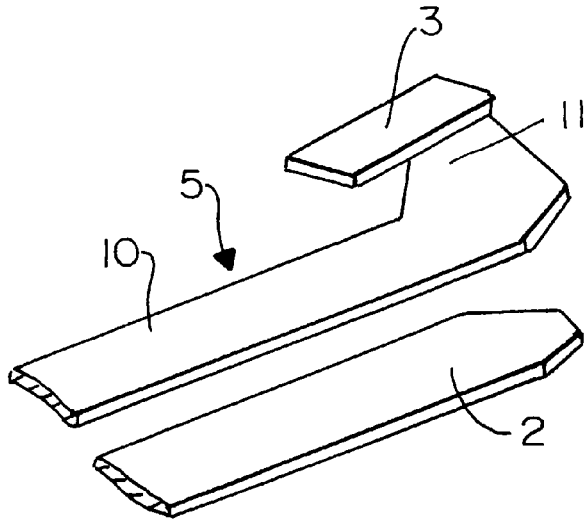
FIG. 3 shows how the second contact spring is bent backward from the stamped receptacle blank.

Referring to FIG. 1, a plurality of receptacle contacts 1 are arranged in parallel, each having first and second contact springs 2 and 3 defining a plug-insertion space 4 therebetween for accommodating a plug contact (not shown). As best seen in FIG. 2, in the blanked receptacle contact the first contact spring 2 is a straight piece integrally connected to an elongated stem piece, and the second contact spring is a straight portion which is connected via a lateral portion 11 to a rod-like piece 10 which is integrally connected to the elongated stem piece 8 via a lateral joint 9, and extends parallel to the first PATENT contact spring 2. As seen in FIG. 3, the second contact spring 3 is bent backwards toward the elongated stem piece 8.

Again referring to FIG. 2, the expanded part 6 of the elongated stem piece is connected to the second contact spring 3 via an associated narrow piece 7 to provide engagement projections which can skive into the opposite sides of the inner wall of an insulating housing (not shown), thereby enabling the receptacle contact 1 to be retained therein. The remaining length of the elongated stem piece 8 which is connected to the expanded part 6 provides a soldering tail.

Still referring to FIG. 2, the receptacle contact 1 may be provided by separating the receptacle contact from the elongated support piece 13 and by bending and placing the second contact spring 3 to face the first contact spring 2. Specifically, in the stamped metal blank each receptacle contact form is structured as follows: the first contact spring 2 is a straight piece integrally connected to an elongated stem piece 8; a crank-like piece 5 is integrally connected to the base of the first contact spring 2 via a lateral joint 9 with its rod-like piece 10 extending parallel to the straight first contact spring 2; and the second contact spring 3 is a straight piece integrally connected to the rod-like piece 10 via a lateral short piece 11. The receptacle contact is connected to a carrier strip 12 via an L-shaped elongated support piece 13, which is integrally connected to the elongated stem piece 8 as indicated at 8*a*. A plurality of receptacle contact forms are arranged at regular interval "P". As each crank-like piece 5 is arranged adjacent to an associated first contact spring with its handle part extending beyond the first contact spring. The receptacle contact forms may be arranged laterally at reduced intervals (for instance, 2 mm) in the stamped metal-sheet blank.

Figure 4:
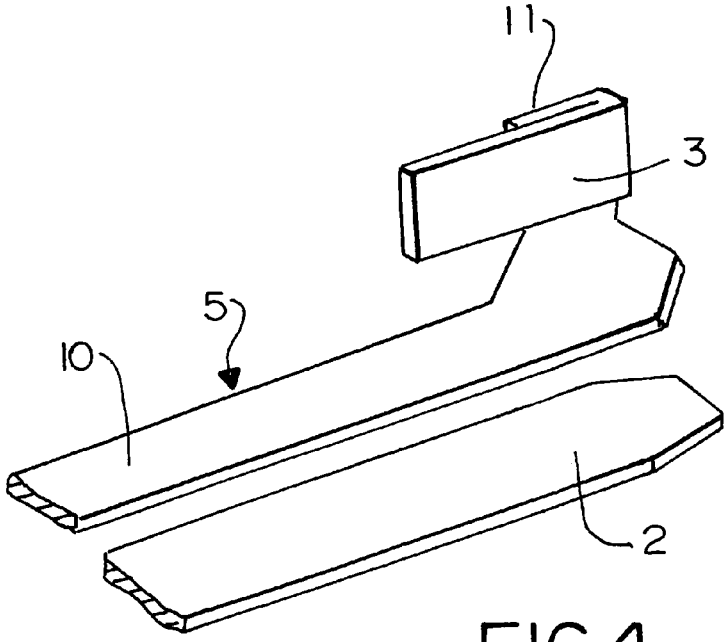
FIG. 4 shows how the bent second contact spring is bent at right angle from the stamped receptacle blank.
Figure 5:
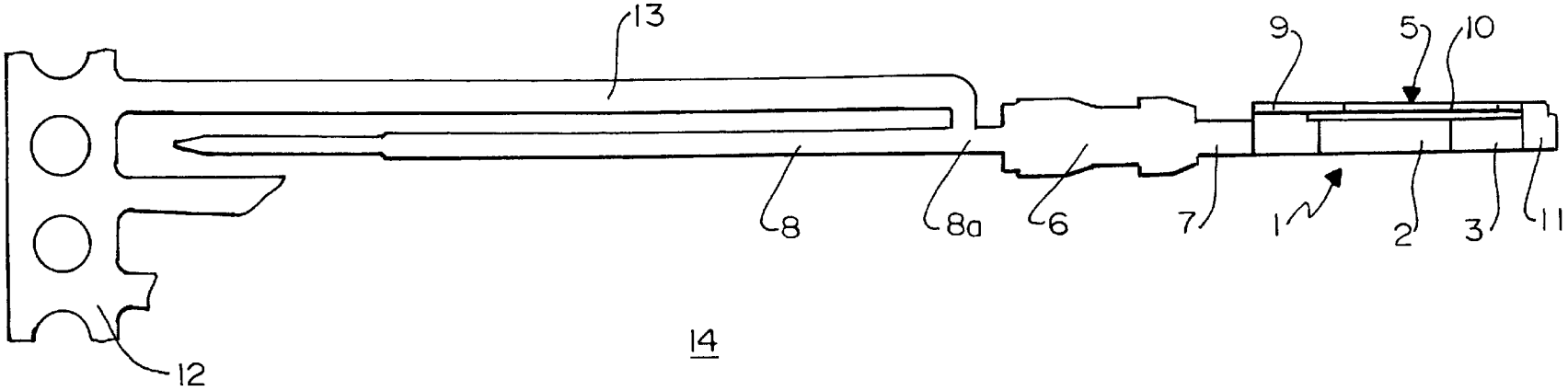
FIG. 5 is a plane view of a stamped receptacle contact with formed contact springs.
Figure 6:
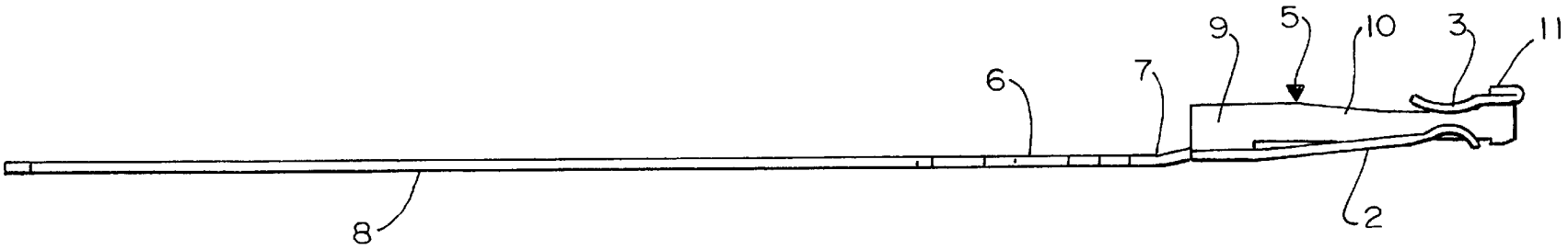
FIG. 6 is a side view of the stamped receptacle contact with contact springs.
Figure 7:
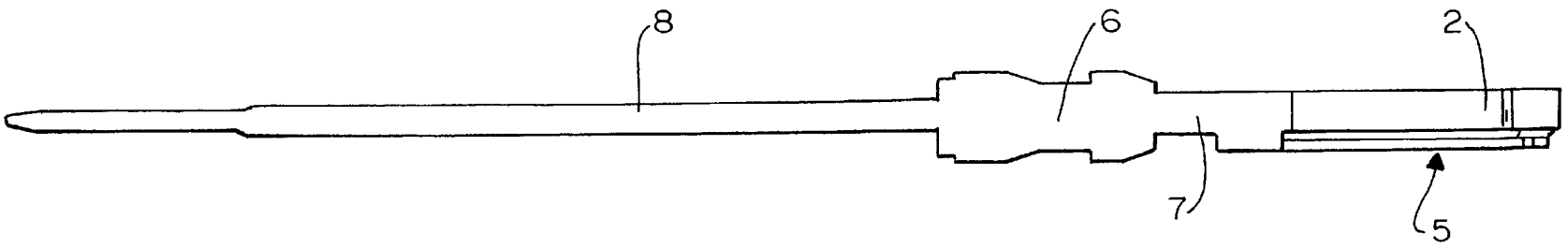
FIG. 7 is a bottom view of the stamped receptacle contact with formed contact springs.
Figure 8:
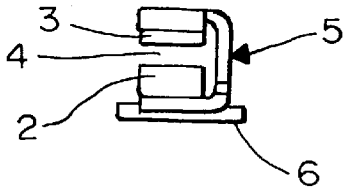
FIG. 8 is a front end view of the stamped receptacle contact with formed contact springs.

The stamped receptacle contact form can be reduced to a receptacle contact piece 1 by: bending the second contact spring 3 backward to be located on the lateral short piece 11 (FIG. 3); bending the lateral short piece 11 perpendicular to the rod-like piece 10 (FIG. 4); and finally bending the lateral joint 9 so as to make the rod-like piece 10 perpendicular to the first contact spring 2, thereby placing the first and second contact pieces 2 and 3 in an opposing face-to-face relationship (FIGS. 5, 6, 7 and 8).

As may be understood from the above, all stamped receptacle contact forms are arranged in parallel at reduced intervals such that a required number of receptacle contacts can be fitted in the insulating housing at one time thus eliminating the necessity of preparing an inserting two sets of receptacle contacts in a staggered relationship. This results in savings of punching, forming, plating and mounting operations, and accordingly the cost involved for making electric connectors will be reduced.

As described above, receptacle contacts may be arranged in parallel at reduced intervals enabling a single set of a plurality of receptacle contact pieces to be inserted into a housing in a single operation to complete an electric connector.

Figure 9:
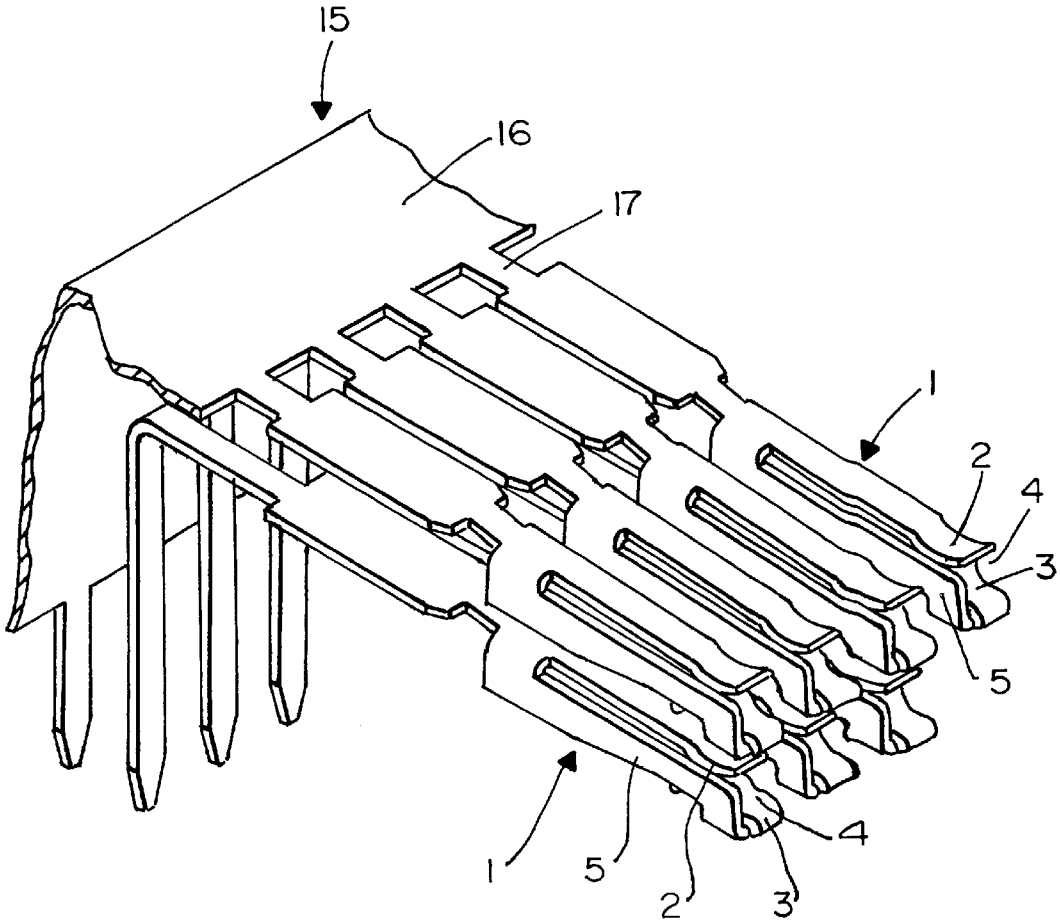
FIG. 9 is a perspective view of parallel-arranged receptacle contacts according to a second embodiment (upper) and the first embodiment of the present invention (lower)
Figure 10:
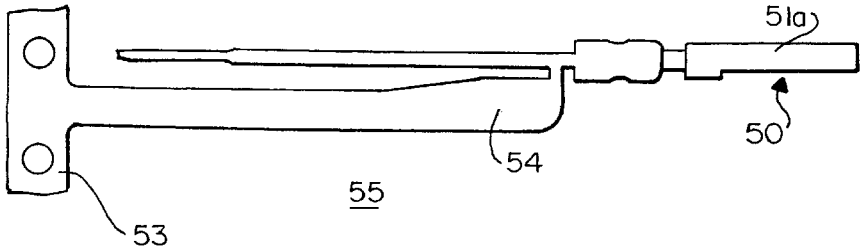
FIG.10 PRIOR ART
FIG. 10 is a plane view of a prior art stamped receptacle contact having formed contact springs.
Figure 11:
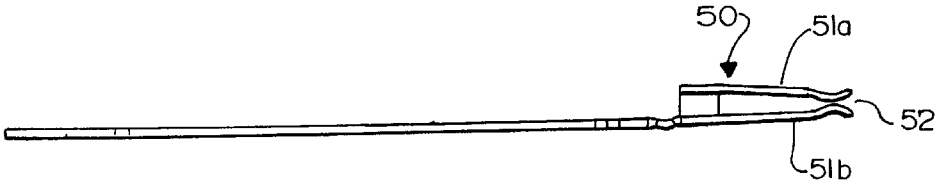
FIG.11 PRIOR ART
FIG. 11 is a side view of a prior art stamped receptacle contact having formed contact springs.
Figure 12:
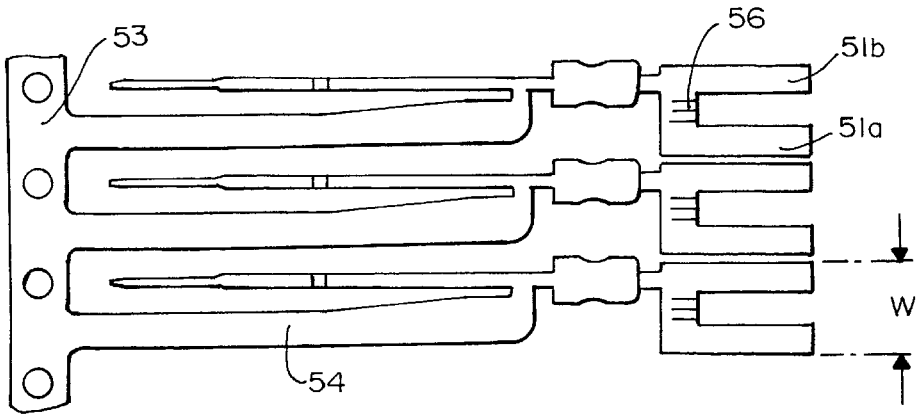
FIG.12 PRIOR ART
FIG. 12 is a plane view of a fragment of a prior art blanked receptacle contact profile.

Referring to FIG. 9, a set of receptacle contacts according to a second embodiment are shown as being located above a set of receptacle contacts made according to the first embodiment. The second embodiment offers the same advantages as the first embodiment described above. Specifically, in the second embodiment receptacle contacts 1 are integrally connected to a lateral ground strip 16 via joints 17. No L-shaped elongated support pieces 13 are used. The lower set of receptacle contacts 1 may be used as signal-conducting contacts, whereas the upper set of receptacle contacts 1 may be used as grounding contacts, resulting in a ground-enhancing type electric connector.

I claim:

1. A plurality of receptacle contacts stamped and formed from blank forms, each receptacle contact having a first and a second contact spring defining a plug-insertion space therebetween, wherein each of said blank forms to be stamped and formed into said receptacle contact comprises:

an elongated stem piece;

a first blank form contact spring to be stamped and formed into said first contact spring, said first blank form contact spring having a first generally straight piece integrally connected to said elongated stem piece, lying in a contact plane and having a first longitudinal axis;

a second blank form contact spring to be stamped and formed into said second contact spring, said second blank form contact spring having a second generally straight piece having a second longitudinal axis connected to said elongated stem piece by a lateral portion which is connected to a rod like piece having a longitudinal axis generally parallel to the first and second longitudinal axes, and said rod like piece is connected to said elongated stem piece by a lateral joint, said second straight piece lying in said contact plane, said a second longitudinal axis that extends generally parallel to and offset from said first longitudinal axis; and wherein said second longitudinal axis of said second straight piece of one of said receptacle contacts is generally in line with said first longitudinal axis of a first straight piece of a contact spring of an adjacent receptacle contact.

2. The plurality of receptacle contacts according to claim 1, wherein said blank forms for said plurality of receptacle contacts are arranged at regular intervals and are integrally connected to a lateral carrier strip via associated support pieces, said carrier strip being integrally connected to a plurality of said elongated stem pieces of the blank forms.

3. The plurality of receptacle contacts according to claim 1, wherein said blank forms for said plurality of receptacle contacts are arranged at regular intervals, and are integrally connected to a lateral ground strip.

4. A method of making receptacle contacts each having first and second contact springs defining a plug-insertion space therebetween, characterized in that the method includes the steps of:

preparing a plurality of generally parallel stamped receptacle contact blank forms wherein each of said receptacle contact blank forms includes a first blank form contact spring having a first generally straight piece with a first longitudinal axis and integrally connected to an elongated stem piece and a second blank form contact spring having a second generally straight piece with a second longitudinal axis generally parallel to said first longitudinal axis and integrally connected to said elongated stem piece by a lateral portion which is connected to a rod like piece having a longitudinal axis generally parallel to the first and second longitudinal axes, and said rod like piece is connected to said elongated stem piece by a lateral joint; and forming each receptacle contact blank form by bending said second straight piece backward; bending said lateral portion perpendicular to said rod like piece; and bending said lateral joint to position said rod like piece perpendicular to said first straight piece, thereby placing said first and second contact springs in an opposing face-to-face relationship.

* * * * *